United States Patent [19]

Euwema et al.

[11] 4,230,362

[45] Oct. 28, 1980

[54] CHILD'S TABLE SEAT

[76] Inventors: George J. Euwema, 1880 NW. 40th Ct.; George W. Euwema, 1920 NW. 40th Ct., both of Fort Lauderdale, Fla. 33309

[21] Appl. No.: 968,383

[22] Filed: Dec. 11, 1978

[51] Int. Cl.[3] ..... A47B 39/00

[52] U.S. Cl. ..... 297/174; D6/9

[58] Field of Search ..... 297/174; D6/9

[56] References Cited

U.S. PATENT DOCUMENTS

| | | | |
|---|---|---|---|
| D. 181,700 | 12/1957 | Armitage | 297/174 UX |
| 2,489,084 | 11/1949 | Ducey | 297/174 |
| 3,126,226 | 3/1964 | Johnson | 297/174 |
| 3,133,760 | 5/1964 | Robinson | 297/174 |
| 3,222,104 | 12/1965 | Remington et al. | 297/174 X |
| 3,243,229 | 3/1966 | Barnhill | 297/174 X |
| 3,253,860 | 5/1966 | Shapiro | 297/174 X |

*Primary Examiner*—Roy D. Frazier
*Assistant Examiner*—Peter A. Aschenbrenner

[57] ABSTRACT

A child's seat which is attachable to a table top or the like for seating the child at the same level as other people seated at the same table. The seat has a fixed, lightweight and rigid frame, with a seat and seat back. The frame has an upper supporting surface which rests on the table and a lower support leg which is held against the underside of the table. Both the supporting surface and the lower support legs diverge to make the seat more stable when it is attached to a table.

3 Claims, 4 Drawing Figures

CHILD'S TABLE SEAT

BACKGROUND OF THE INVENTION

This invention relates to a new and improved seat, and more particularly to a child's seat which may be supported near the edge of a table or the like. The present invention is the subject of Design Patent Applications, Ser. No. 951,473, filed Oct. 16, 1978, and Ser. No. 859,228, filed Dec. 9, 1977. The latter invention was first used on Dec. 1, 1977.

In the past, a number of seats have been known which could be supported from a table. Examples of the prior art are contained in U.S. Pat. Nos. 3,132,895, issued May 12, 1964; 3,126,226, issued Mar. 24, 1964; and 3,222,104, issued Dec. 7, 1965. However, many of the prior art seats have had difficulties in maintaining stability when a child is seated at the table. Also, many prior art devices were complicated by collapsible members which had a tendency to pinch children's fingers. Further, other devices needed various adjustments to attach to different tables.

SUMMARY OF THE INVENTION

The present invention relates to a new and improved infant seat that is easily and quickly attachable to a table or the like without the use of clamps or adjustments and without the necessity of unfolding a complicated apparatus.

Accordingly, it is an object of the present invention to provide a lightweight, inexpensive child's seat which may be readily attached to a table or the like.

It is another object of the present invention to provide a child's seat which will remain stable when attached to a table or the like and a child is seated therein.

It is a further object of the present invention to provide a child's seat which is free from moving parts and thus cannot pinch or hurt a child.

It is still a further object of the present invention to provide a child's seat which may be attached to most tables without any clamps or adjustments.

In accordance with these and other objects which will be apparent hereinafter, the instant invention will now be described with particular reference to the accompanying drawings.

DESCRIPTION OF THE PREFERRED EMBODIMENT

Figure 1:
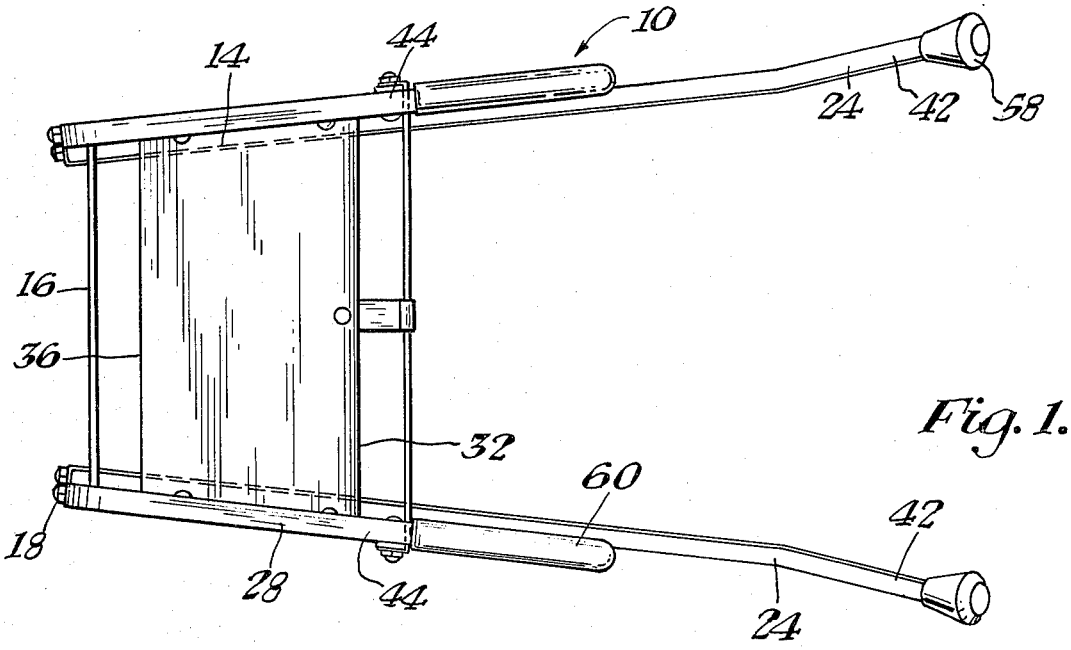
FIG. 1 is a top plan view of the present invention.
Figure 2:
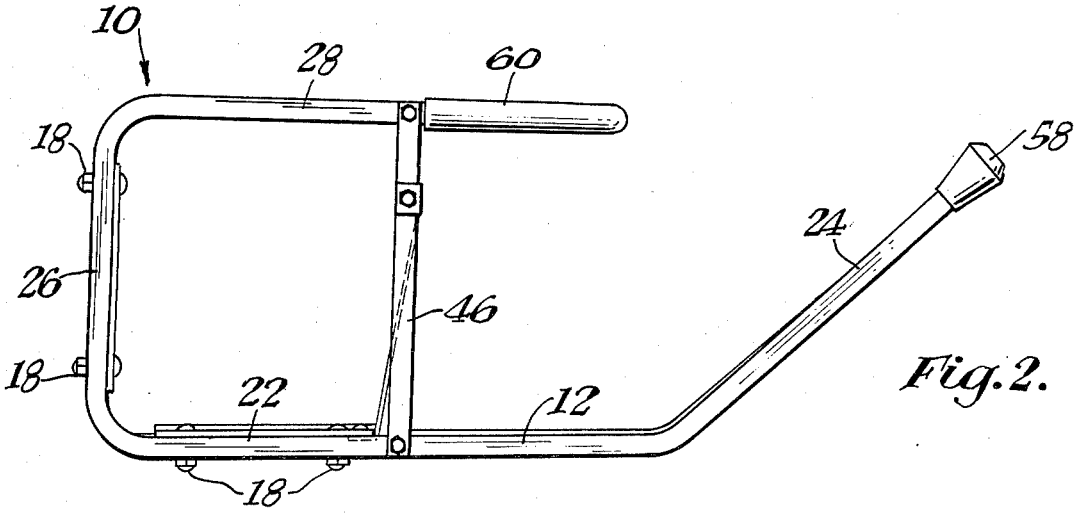
FIG. 2 is a right-side elevational view of FIG. 1.

Referring now in detail to the drawings, wherein an embodiment of the present invention is shown, the child's table seat, generally designated as numeral 10 is clearly illustrated. The child's table seat consists of a pair of single piece support members 12, and a bottom seat portion 14 and a back seat portion 16 disposed between the support members 12.

The support members 12 generally are constructed of tubular aluminum stock or square aluminum stock as shown in the drawings and are generally U-shaped positioned to lie on a side of the U-shape. The generally horizontal bottom member 22 of the U-shape has an extended upturned foot portion 24 projecting from the open end. The normal bottom member of a U-shape is now a vertical member 26 extending across the closed end. The top member 28 of the generally U-shaped support members 12 extend from the top of the vertical member 26 is a direction generally parallel with the horizontal bottom member 22.

The bottom seat portion 14 is disposed between the two support members 12 and is fixed to the bottom member 22 by fasteners 18. The support members 12 also have the back seat portion 16 disposed between the vertical members 26. The back seat portion 16 is also fastened to the support members 12 by fasteners 18.

Both the bottom seat portion 14 and the back seat portion 16 are quadrilaterally shaped with the front edge 32 and top edge 34 of the respective portions being longer than the respectively parallel rear edge 36 and bottom edge 38. These longer front 32 and top 34 edges cause the support members to diverge from the center line at the distal end 42 of the foot portion 24 and the distal end 44 of the top member 28. The divergence of the support members 12 allows a wider stance for the baby seat, thereby making the seat more stable when a child sits therein.

A pair of brace members 46 extend vertically across the open end of the generally U-shaped support members 12 from the horizontal bottom member 22 to the top member 28. The brace members 46 prevent the bottom member 22 from being displaced in a downward direction when the seat is supported on a table and a child is placed in the baby seat 10. The brace members 46 cause a torque to be applied to the baby seat 10 through the upturned foot portion 24. This applied torque increases the amount of force the foot portion 24 applies to a table or the like. Thus, a spring-like action is provided to the baby seat 10 as a child is placed in the seat whereby the weight of the child aids in keeping the seat from moving.

The flat brace 46 is attached to the flat outside of portion 22 and 28. Since the flat members not only diverge toward ends 58 and 60 in a horizontal direction, but diverge in a vertical direction from the lower rear area of the child's table seat, the spring-like action provided when the child is placed in the seat 14 is also due to the fact that the upper surfaces of portion 22 of the members is in a plane that rises toward the center of the seat 14.

Figure 3:
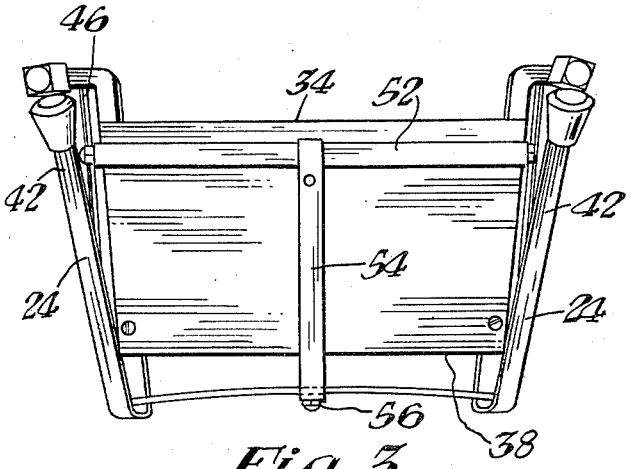
FIG. 3 is a front elevational view of FIG. 1.
Figure 4:
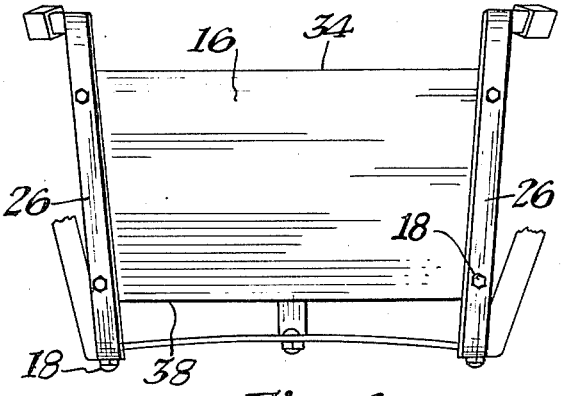
FIG. 4 is a rear elevational view of FIG. 1.

As illustrated in FIG. 3, a flexible horizontal restraining member 52 may be disposed between the brace members 46, with a vertical member 54 extending from the horizontal restraining member to the bottom seat portion 14. The lower end of the vertical restraining member 54 may be secured to the seat portion 14 by fastening means 56, while the upper end may be in the form of a loop, slidable along the horizontal restraining member 52.

The ends of the support members 12 may be covered by non-slip end caps 58 and 60 such as rubber covers, to aid in preventing the seat from moving when attached to a table or the like.

The instant invention has been shown and described herein in what is considered to be the most practical and preferred embodiment. It is recognized, however, that departures may be made therefrom within the scope of the invention and that obvious modifications will occur to a person skilled in the art.

What we claim is:

1. A table seat for a child, comprising:

a frame means including a pair of generally U-shaped support members in spaced relation to each other and an angularly upward disposed bearing leg extending from said support members;

each said generally U-shaped support members having a first leg portion, a second leg portion generally parallel to said first leg portion, and an upwardly extending portion connecting said first leg portion to said second leg portion;

a seat means secured transversely between the pair of said first leg portion of said support members at the rearward end of said first leg portion, said seat means including a forward and rear portion;

a back means secured between the pair of said upward extending portion of said U-shaped support members;

a brace means extending vertically and attached between each said first leg portion and said second leg portion, forward of said seat means for maintaining a spaced relation between said first leg portion and said second leg portion when a child is in said seat; and a restraining means having a horizontal member secured between the pair of said second leg portion and a vertical member secured at a first end to said seat means and at a second end to said horizontal member for keeping a child in said seat when attached to a table;

said generally U-shaped support members positioned with each said first leg portion, said second leg portion and said upwardly extending portion positioned in a diverging manner from the rear of said seat means.

2. A table seat for a child as set forth in claim 1, wherein:

said second leg portion is movably detachable upon the upper surface of a table for support thereupon.

3. A table seat for a child as set forth in claim 1, wherein:

said bearing leg is movably urged into contact with the under surface of a table when said second leg portion is supported upon said table.

* * * * *